US011433317B1

(12) United States Patent
Cairns et al.

(10) Patent No.: US 11,433,317 B1
(45) Date of Patent: Sep. 6, 2022

(54) BUILDING TOY SET

(71) Applicants: Impact Brothers, LLC, Lewis Center, OH (US); Timothy David Holmes, Columbus, OH (US)

(72) Inventors: Michael Allen Cairns, Lewis Center, OH (US); Timothy David Holmes, Columbus, OH (US)

(73) Assignees: Impact Brothers, LLC, Lewis Center, OH (US); Timothy David Holmes, Columbus, OH (US)

( * ) Notice: Subject to any disclaimer, the term of this patent is extended or adjusted under 35 U.S.C. 154(b) by 0 days.

(21) Appl. No.: 16/825,923

(22) Filed: Mar. 20, 2020

Related U.S. Application Data

(60) Provisional application No. 62/821,925, filed on Mar. 21, 2019.

(51) Int. Cl.
*A63H 33/10* (2006.01)
*A63H 33/04* (2006.01)

(52) U.S. Cl.
CPC ..... *A63H 33/102* (2013.01); *A63H 33/04* (2013.01)

(58) Field of Classification Search
CPC ..... A63H 33/04; A63H 33/044; A63H 33/10; A63H 33/101; A63H 33/102; A63H 33/105; A63H 33/12
See application file for complete search history.

(56) References Cited

U.S. PATENT DOCUMENTS 2,805,089 A * 9/1957 Hansen ..... F16L 37/088 285/317
3,959,915 A * 6/1976 Kettlestrings ..... A63H 27/14 473/588
3,998,002 A 12/1976 Nathanson
4,352,255 A 10/1982 Warehime
4,467,572 A 8/1984 Somers
5,003,746 A * 4/1991 Wilston ..... A63H 33/08 52/592.1

(Continued)

OTHER PUBLICATIONS

"Craft Stick Connectors Easy Pack", S&S Worldwide Website, Web page <https://www.ssww.com/item/craft-stick-connectors-easy-pack-W12461/index.php#product_activities>, 2 pages, dated at least as early as Oct. 18, 2018, retrieved from www.ssww.com website on Jan. 19, 2021.

*Primary Examiner* — Eugene L Kim
*Assistant Examiner* — Alyssa M Hylinski
(74) *Attorney, Agent, or Firm* — The Law Office of Patrick F. O'Reilly III, LLC

(57) ABSTRACT

A building toy set is disclosed herein. The building toy set may include a plurality of elongate stick members, at least one of the plurality of elongate stick members having at least one rounded end; and a plurality of connector members, at least one of the plurality of connector members being in the form of a two-sided parallel connector having a body portion defining two slots, each of the two slots being disposed adjacent to, and extending parallel to one another. At least one of the plurality of connector members may include a body portion defining a bulb-shaped slot bounded by a straight wall portion and at least one curved wall portion, the at least one curved wall portion enabling one of the plurality of elongate stick members to be disposed at an angle relative to a longitudinal axis of the body portion of the connector member.

20 Claims, 12 Drawing Sheets

(56) References Cited

U.S. PATENT DOCUMENTS

| | | | | |
|---|---|---|---|---|
| 5,121,526 | A * | 6/1992 | Burkard | A63H 33/10 24/336 |
| 5,487,690 | A | 1/1996 | Stoffle et al. | |
| 5,647,181 | A * | 7/1997 | Hunts | A63H 33/10 312/265.5 |
| 5,672,087 | A * | 9/1997 | De La Paz Rizo | A63H 33/08 446/108 |
| 5,729,867 | A * | 3/1998 | Carmichael | G09F 15/0068 16/225 |
| 6,015,149 | A | 1/2000 | Burk | |
| 6,645,032 | B2 | 11/2003 | Barringer et al. | |
| 6,676,474 | B2 | 1/2004 | Glickman | |
| 7,444,792 | B2 | 11/2008 | Matson | |
| 8,968,046 | B2 | 3/2015 | Cochella | |
| D757,860 | S | 5/2016 | Cochella | |
| 9,895,623 | B2 | 2/2018 | Cochella | |
| 2003/0224690 | A1 * | 12/2003 | Manville | A63H 33/101 446/113 |
| 2008/0066393 | A1 * | 3/2008 | Sorensen | E04B 1/3211 52/81.1 |
| 2008/0188158 | A1 | 8/2008 | Massa | |
| 2009/0149110 | A1 * | 6/2009 | Scarborough | A63H 33/084 446/120 |
| 2012/0122368 | A1 | 5/2012 | Jensen | |
| 2016/0317939 | A1 * | 11/2016 | Fernandez | A63H 33/084 |
| 2017/0113158 | A1 | 4/2017 | Cochella | |
| 2018/0021689 | A1 * | 1/2018 | Cochella | A63H 33/101 446/124 |
| 2019/0070519 | A1 * | 3/2019 | Klein | G09B 1/32 |

* cited by examiner

FIG. 1
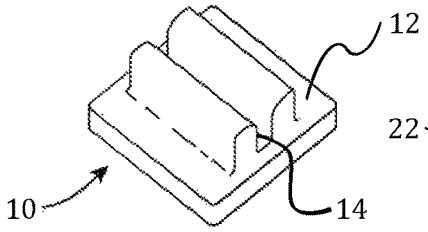
FIG. 1A
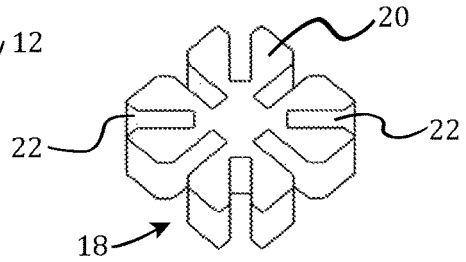
FIG. 1B
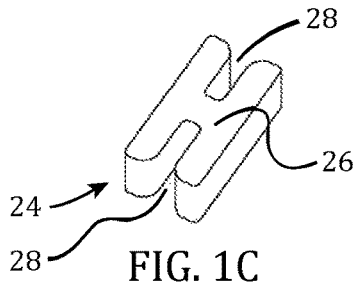
FIG. 1C
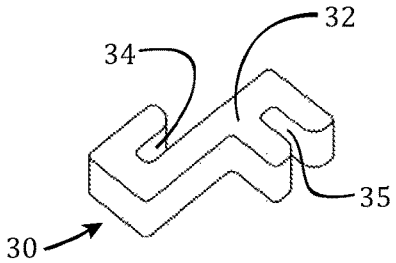
FIG. 1D
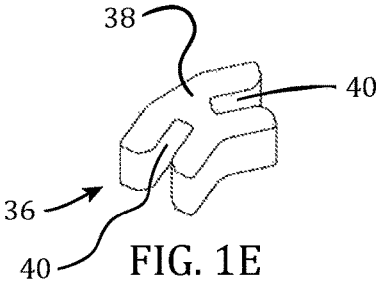
FIG. 1E
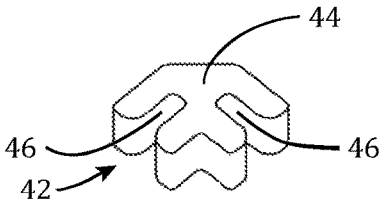
FIG. 1F
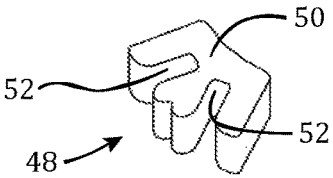
FIG. 1G
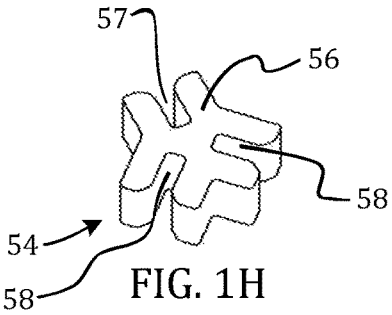
FIG. 1H
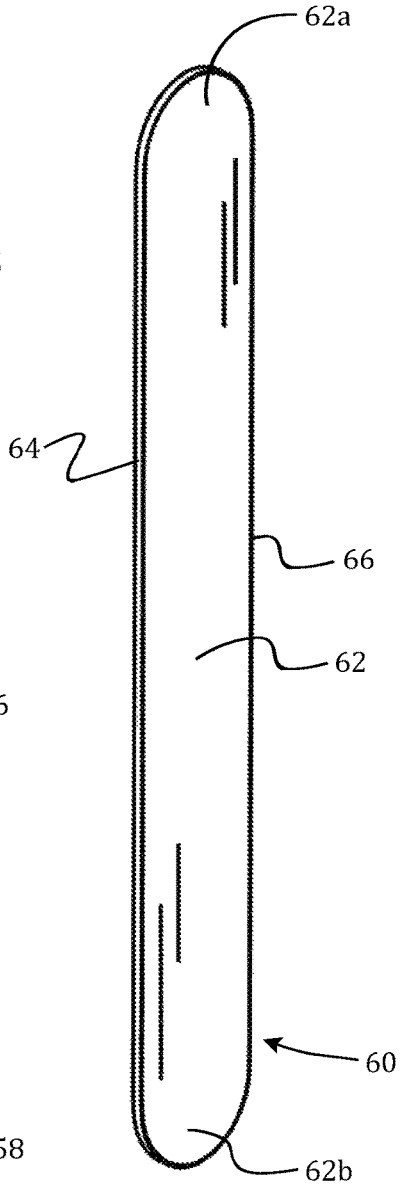
FIG. 1I

FIG. 5
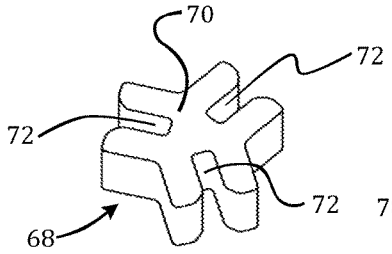
FIG. 5A
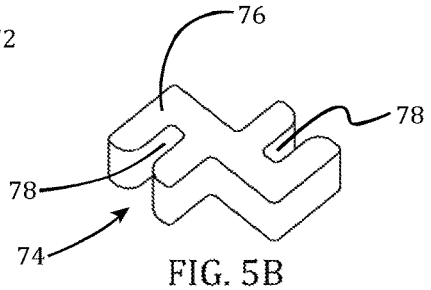
FIG. 5B
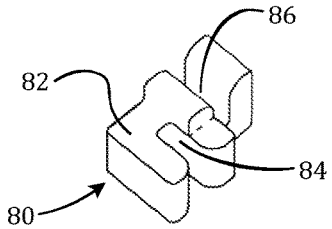
FIG. 5C
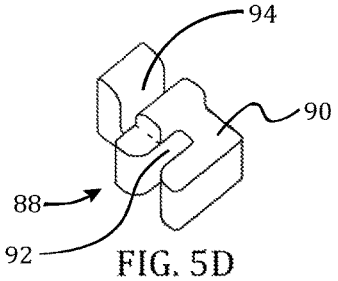
FIG. 5D
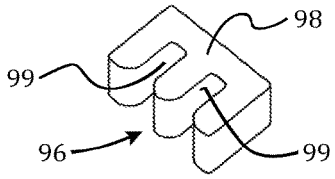
FIG. 5E
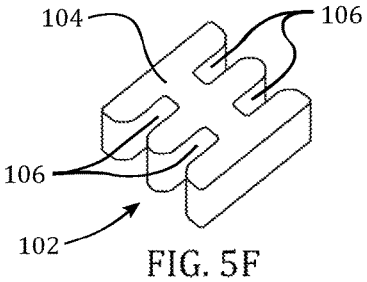
FIG. 5F
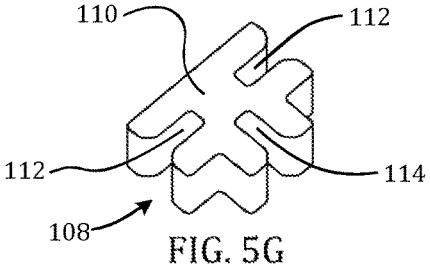
FIG. 5G
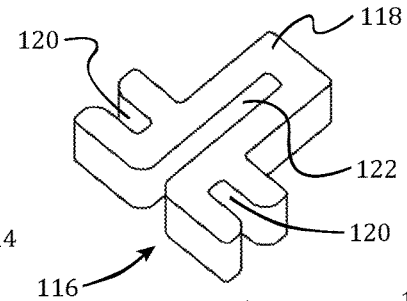
FIG. 5H
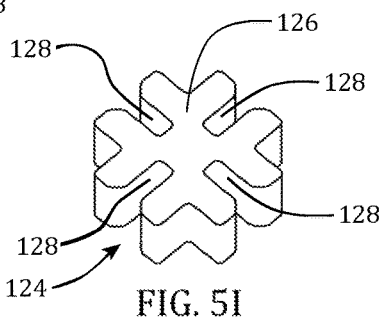
FIG. 5I FIG. 6
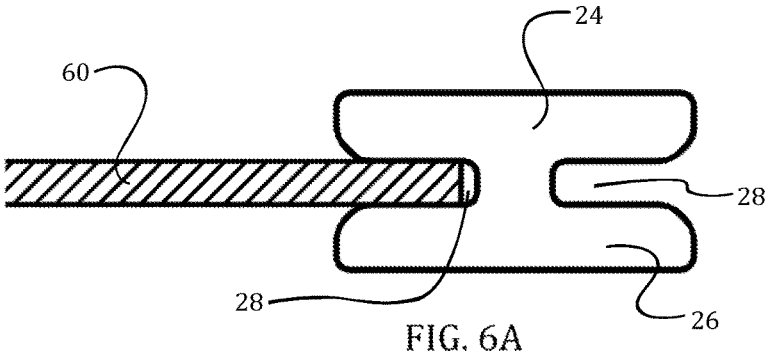
FIG. 6A
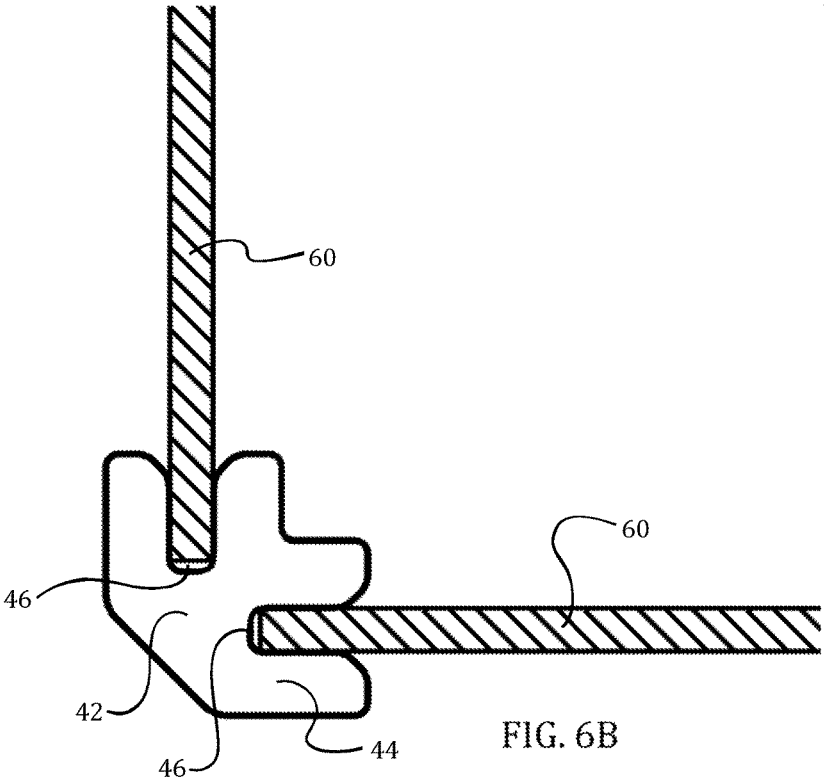
FIG. 6B FIG. 8
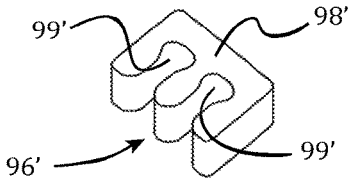
FIG. 8A
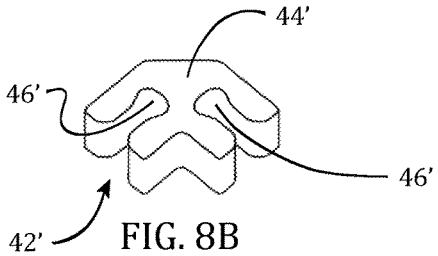
FIG. 8B
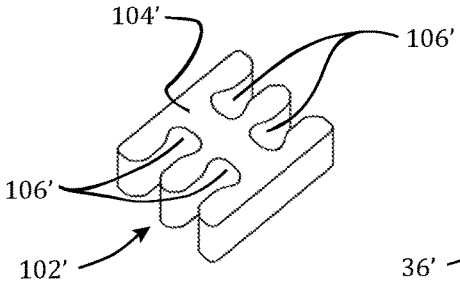
FIG. 8C
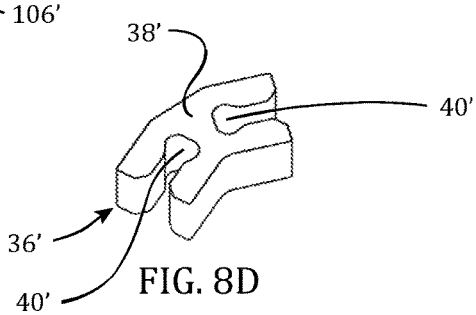
FIG. 8D
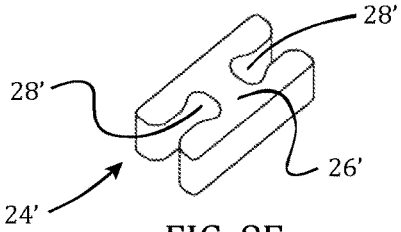
FIG. 8E
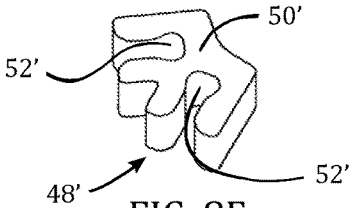
FIG. 8F
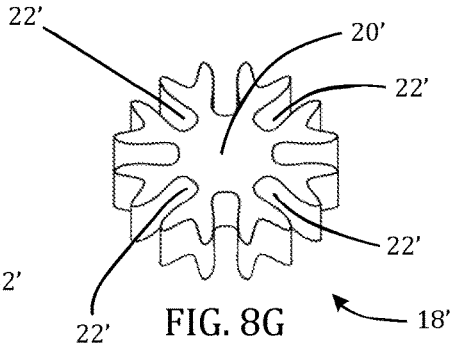
FIG. 8G FIG. 9
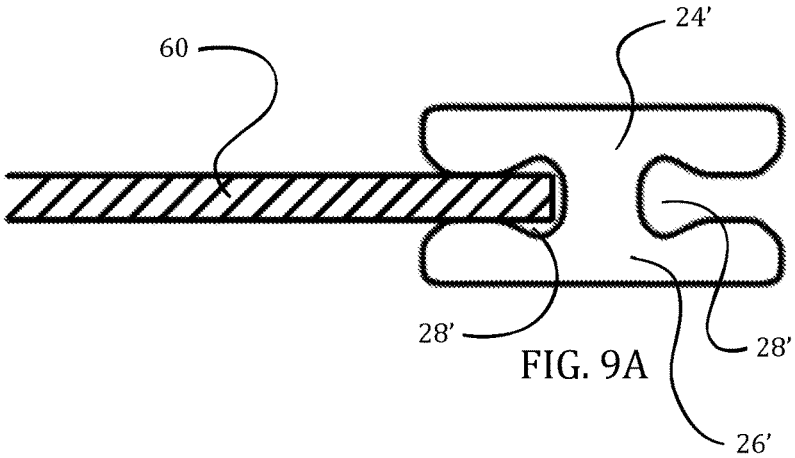
FIG. 9A
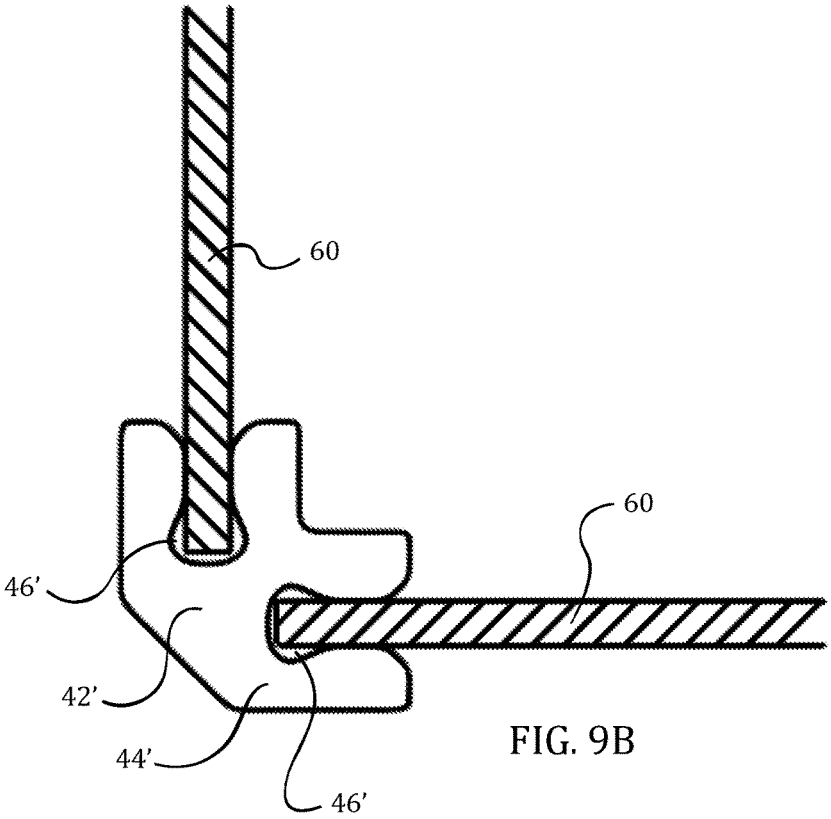
FIG. 9B

BUILDING TOY SET

CROSS-REFERENCE TO RELATED APPLICATIONS

This patent application claims priority to, and incorporates by reference in its entirety, U.S. Provisional Patent Application No. 62/821,925, entitled "Building Toy Set", filed on Mar. 21, 2019.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

INCORPORATION BY REFERENCE OF MATERIAL SUBMITTED ON A COMPACT DISK

Not Applicable.

BACKGROUND OF THE INVENTION

1. Field of the Invention

The invention generally relates to a building toy set. More particularly, the invention relates to a building toy set that enables a myriad of different structures to be formed using stick members connected to one another by connector members.

2. Background

Modern technology has forced its way into our culture stripping creativity from the minds of children and adults alike. Parents become concerned as the system takes over and children are depleted of their own ability to create and explore. While the mind has a great ability to mentally construct with the imagination, the body is limited by resources. Children cannot find enough resources to keep their imagination fueled. And most building toys are too expensive for a good percentage of the population to purchase. The typical building toys that families can afford to purchase are limited in size, and therefore limit a child's imagination.

Therefore, what is needed is a building toy set that is capable of sparking creativity in the users thereof, and may further expand its user's knowledge of engineering. Moreover, a building toy set is needed that is relatively inexpensive, does not require the use of adhesives, and comprises reusable components. Furthermore, a building toy set is needed that helps to build relationships among the users thereof by, for example, bonding family members together. In addition, a building toy set is needed that helps children learn new skills.

BRIEF SUMMARY OF EMBODIMENTS OF THE INVENTION

Accordingly, the present invention is directed to a building toy set that substantially obviates one or more problems resulting from the limitations and deficiencies of the related art.

In accordance with one or more embodiments of the present invention, there is provided a building toy set that includes a plurality of elongate stick members, at least one of the plurality of elongate stick members having at least one rounded end; and a plurality of connector members, at least one of the plurality of connector members being in the form of a two-sided parallel connector having a body portion defining two slots, each of the two slots being disposed adjacent to, and extending parallel to one another.

In a further embodiment of the present invention, the at least one rounded end of the at least one of the plurality of elongate stick members comprises a first rounded end and a second rounded end, the first rounded end being oppositely disposed relative to the second rounded end.

In yet a further embodiment, the plurality of connector members further comprise a straight connector having a body portion defining aligned oppositely disposed slots.

In still a further embodiment, the plurality of connector members further comprise a 90 degree connector having a body portion defining two slots oriented at 90 degrees relative to one another.

In yet a further embodiment, the plurality of connector members further comprise a T-joint connector having a body portion defining three slots, first and second ones of the three slots being oppositely disposed and aligned, and a third one of the three slots being disposed at a 90 degree angle relative to the first and second ones of the three slots.

In still a further embodiment, the plurality of connector members further comprise an eight-sided connector having a body portion defining eight slots, each of the eight slots being successively spaced apart from one another by forty-five degrees.

In yet a further embodiment, the plurality of connector members further comprise a two-sided 135 degree connector having a body portion defining two slots spaced apart from one another by 135 degrees.

In still a further embodiment, the plurality of connector members further comprise a two-sided 60 degree connector having a body portion defining two slots spaced apart from one another by 60 degrees.

In yet a further embodiment, the plurality of connector members further comprise a base connector having a body portion defining an upwardly extending slot, the upwardly extending slot of the base connector being bounded by a curved bottom surface to accommodate an insertion of the at least one rounded end of the at least one of the plurality of elongate stick members into the upwardly extending slot.

In still a further embodiment, at least one of the plurality of connector members comprises a body portion defining a bulb-shaped slot, the bulb-shaped slot being bounded by a straight wall portion and at least one curved wall portion, the at least one curved wall portion of the bulb-shaped slot enabling one of the plurality of elongate stick members to be disposed at an angle relative to a longitudinal axis of the body portion of the at least one of the plurality of connector members.

In yet a further embodiment, the plurality of connector members further comprise a four-sided connector having a body portion defining four slots, each of the four slots being successively spaced apart from one another by ninety degrees.

In accordance with one or more other embodiments of the present invention, there is provided a building toy set that includes a plurality of elongate stick members, at least one of the plurality of elongate stick members having at least one rounded end; and a plurality of connector members, at least one of the plurality of connector members comprising a body portion defining a bulb-shaped slot, the bulb-shaped slot being bounded by a straight wall portion and at least one curved wall portion, the at least one curved wall portion of the bulb-shaped slot enabling one of the plurality of elongate stick members to be disposed at an angle relative to a longitudinal axis of the body portion of the at least one of the plurality of connector members.

In a further embodiment of the present invention, the at least one rounded end of the at least one of the plurality of elongate stick members comprises a first rounded end and a second rounded end, the first rounded end being oppositely disposed relative to the second rounded end.

In yet a further embodiment, at least one of the plurality of connector members comprises a 90 degree connector having a body portion defining two slots oriented at 90 degrees relative to one another.

In still a further embodiment, at least one of the plurality of connector members comprises an eight-sided connector having a body portion defining eight slots, each of the eight slots being successively spaced apart from one another by forty-five degrees.

In yet a further embodiment, at least one of the plurality of connector members comprises a two-sided 135 degree connector having a body portion defining two slots spaced apart from one another by 135 degrees.

In still a further embodiment, at least one of the plurality of connector members comprises a two-sided 60 degree connector having a body portion defining two slots spaced apart from one another by 60 degrees.

In yet a further embodiment, at least one of the plurality of connector members comprises a straight connector having a body portion defining aligned oppositely disposed slots.

In still a further embodiment, at least one of the plurality of connector members comprises a two-sided parallel connector having a body portion defining two slots, each of the two slots being disposed adjacent to, and extending parallel to one another.

In yet a further embodiment, the at least one curved wall portion bounding the bulb-shaped slot comprises a proximal curved wall portion at an entrance to the bulb-shaped slot and a distal curved wall portion at a terminus of the bulb-shaped slot.

It is to be understood that the foregoing general description and the following detailed description of the present invention are merely exemplary and explanatory in nature. As such, the foregoing general description and the following detailed description of the invention should not be construed to limit the scope of the appended claims in any sense.

BRIEF DESCRIPTION OF THE SEVERAL VIEWS OF THE DRAWINGS

The invention will now be described, by way of example, with reference to the accompanying drawings, in which:

FIG. 1 illustrates perspective views of various types of connector members and a stick member of a building toy set, according to a first illustrative embodiment of the invention;

FIG. 1A is a perspective view of a first type of connector member of a building toy set according to the first illustrative embodiment of the invention;

FIG. 1B is a perspective view of a second type of connector member of the building toy set according to the first illustrative embodiment;

FIG. 1C is a perspective view of a third type of connector member of the building toy set according to the first illustrative embodiment;

FIG. 1D is a perspective view of a fourth type of connector member of the building toy set according to the first illustrative embodiment;

FIG. 1E is a perspective view of a fifth type of connector member of the building toy set according to the first illustrative embodiment;

FIG. 1F is a perspective view of a sixth type of connector member of the building toy set according to the first illustrative embodiment;

FIG. 1G is a perspective view of a seventh type of connector member of the building toy set according to the first illustrative embodiment;

FIG. 1H is a perspective view of an eighth type of connector member of the building toy set according to the first illustrative embodiment;

FIG. 1I is a perspective view of a stick member of the building toy set according to the first illustrative embodiment;

FIG. 5 illustrates perspective views of other types of connector members of the building toy set according to the first illustrative embodiment of the invention;

FIG. 5A is a perspective view of a ninth type of connector member of the building toy set according to the first illustrative embodiment;

FIG. 5B is a perspective view of a tenth type of connector member of the building toy set according to the first illustrative embodiment;

FIG. 5C is a perspective view of an eleventh type of connector member of the building toy set according to the first illustrative embodiment;

FIG. 5D is a perspective view of a twelfth type of connector member of the building toy set according to the first illustrative embodiment;

FIG. 5E is a perspective view of a thirteenth type of connector member of the building toy set according to the first illustrative embodiment;

FIG. 5F is a perspective view of a fourteenth type of connector member of the building toy set according to the first illustrative embodiment;

FIG. 5G is a perspective view of a fifteenth type of connector member of the building toy set according to the first illustrative embodiment;

FIG. 5H is a perspective view of a sixteenth type of connector member of the building toy set according to the first illustrative embodiment;

FIG. 5I is a perspective view of a seventeenth type of connector member of the building toy set according to the first illustrative embodiment;

FIG. 6 illustrates sectional views of stick members and connector members according to the first illustrative embodiment;

FIG. 6A is an enlarged sectional view illustrating a stick member attached to the connector member of FIG. 1C;

FIG. 6B is an enlarged sectional view illustrating two stick members connected to one another using the connector member of FIG. 1F;

FIG. 8 illustrates perspective views of various types of connector members of a building toy set, according to a second illustrative embodiment of the invention;

FIG. 8A is a perspective view of a first type of connector member of a building toy set, according to a second illustrative embodiment of the invention;

FIG. 8B is a perspective view of a second type of connector member of a building toy set, according to the second illustrative embodiment of the invention;

FIG. 8C is a perspective view of a third type of connector member of a building toy set, according to the second illustrative embodiment of the invention;

FIG. 8D is a perspective view of a fourth type of connector member of a building toy set, according to the second illustrative embodiment of the invention;

FIG. 8E is a perspective view of a fifth type of connector member of a building toy set, according to the second illustrative embodiment of the invention;

FIG. 8F is a perspective view of a sixth type of connector member of a building toy set, according to the second illustrative embodiment of the invention;

FIG. 8G is a perspective view of a seventh type of connector member of a building toy set, according to the second illustrative embodiment of the invention;

FIG. 9 illustrates sectional views of stick members and connector members according to the second illustrative embodiment;

FIG. 9A is an enlarged sectional view illustrating a stick member attached to the connector member of FIG. 8E;

FIG. 9B is an enlarged sectional view illustrating two stick members connected to one another using the connector member of FIG. 8B;

Throughout the figures, the same parts are always denoted using the same reference characters so that, as a general rule, they will only be described once.

DETAILED DESCRIPTION OF EMBODIMENTS OF THE INVENTION

Figures 2, 2A, 2B:
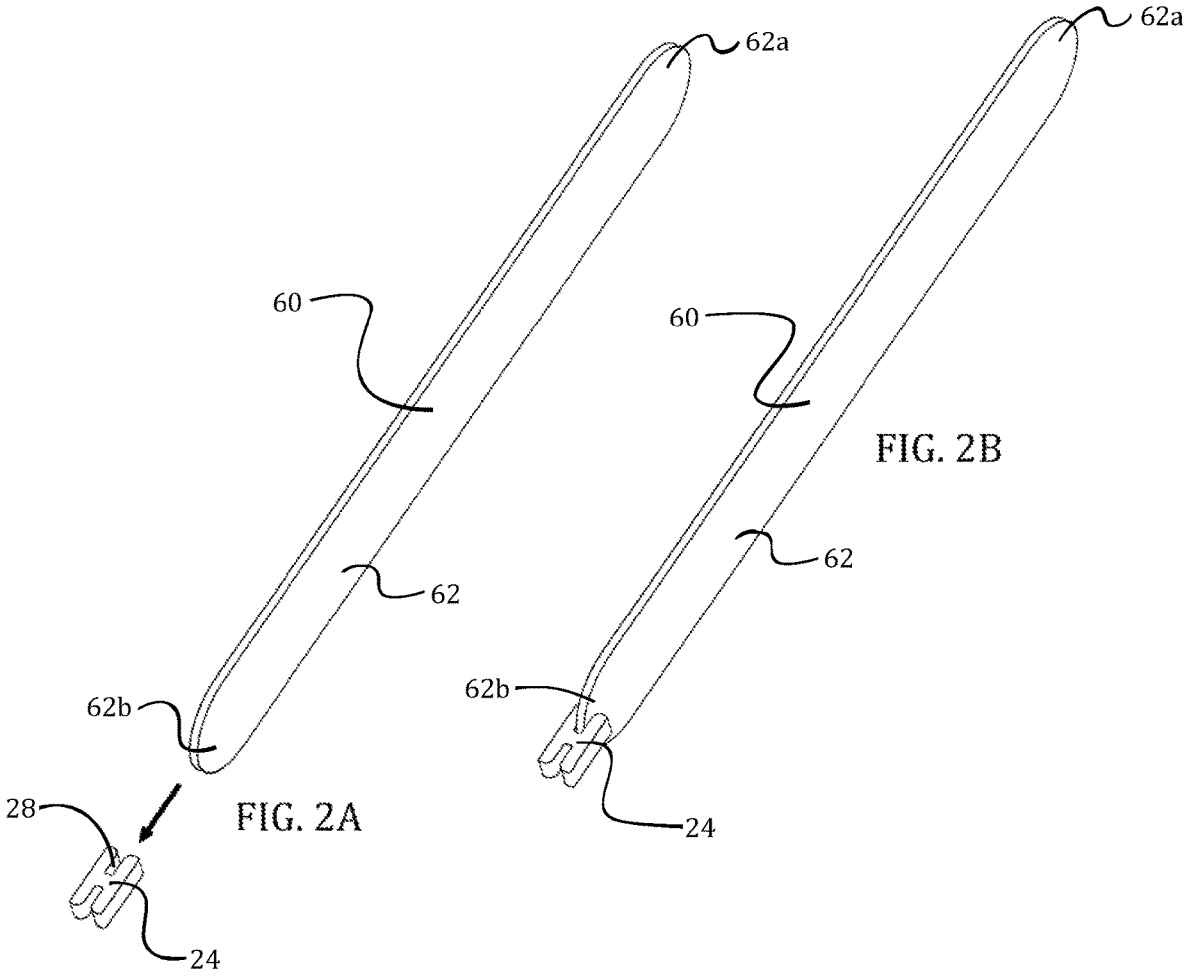
FIG. 2 illustrates perspective views of a stick member and a connector member according to the first illustrative embodiment.
FIG. 2A is a perspective view illustrating the manner in which the stick member is attached to the connector member of FIG. 1C.
FIG. 2B is a perspective view illustrating the stick member after it has been attached to the connector member of FIG. 1C.

A first illustrative embodiment of a building toy set 100 is shown in FIGS. 1-7. With initial reference to FIGS. 1A, 1C, 1F, 1I, 2A, 2B, and 7, the building toy set 100 generally comprises a plurality of elongate stick members 60 (see FIG. 1I), the plurality of elongate stick members 60 having rounded ends 62*a*, 62*b*; and a plurality of connector members 10, 24, 42, a first one 10 of the plurality of connector members 10, 24, 42 being in the form of a base connector 10 having a body portion 12 defining an upwardly extending slot 14, the upwardly extending slot 14 of the base connector 10 being bounded by a curved bottom surface 16 (see FIG. 4A) to accommodate an insertion of a rounded end 62*a*, 62*b* of one of the plurality of elongate stick members 60 into the upwardly extending slot 14, a second one 24 of the plurality of connector members 10, 24, 42 being in the form of a straight connector 24 having a body portion 26 defining aligned oppositely disposed slots 28 (see FIG. 1C), and a third one 42 of the plurality of connector members 10, 24, 42 being in the form of a 90 degree connector 42 having a body portion 44 defining slots 46 oriented at 90 degrees relative to one another (see FIG. 1F). In addition to the connector members 10, 24, 42 described above, in the first illustrative embodiment, a basic version of the building toy set 100 may further include the connector members 18, 36, 48, 54, 96, 108, and 124 that are depicted in FIGS. 1B, 1E, 1G, 1H, 5E, 5G, and 5I, respectively. The structural features of these connector members 18, 36, 48, 54, 96, 108, 124 will be explained hereinafter.

In the first illustrative embodiment, referring collectively to FIGS. 1I, 2A, 2B, 3, 4C, and 7, it can be seen that the elongate stick members 60 are used as the primary structural elements in the building toy set 100. Each of the elongate stick members 60 in the illustrative building toy set 100 comprises an elongate body portion 62 with a first rounded end 62*a* and a second rounded end 62*b* (refer to FIG. 1I). The first rounded end 62*a* of each elongate stick member 60 is oppositely disposed relative to the second rounded end 62*b* thereof. The elongate body portion 62 of each elongate stick member 60 is bounded by a first longitudinally-extending side edge 64 and a second longitudinally-extending side edge 66 (see FIG. 1I). In the first illustrative embodiment, the elongate stick members 60 may be in the form of jumbo craft sticks that are formed from wood. The elongate stick members 60 of the first illustrative embodiment may have the following exemplary dimensions: (i) a six (6) inch length, (ii) a five-eighths (⅝) inch width, and (iii) a thickness of approximately 0.06 inches. In one or more embodiments, the elongate stick members 60 may be cut to length so that a larger variety of structures are able to be built. As will be explained in further detail below, the elongate stick members 60 of the building toy set 100 are connected to one another in various ways using selected ones of the connector members 10, 18, 24, 36, 42, 48, 54, 96, 108, 124.

Figures 4, 4A, 4B, 4C:
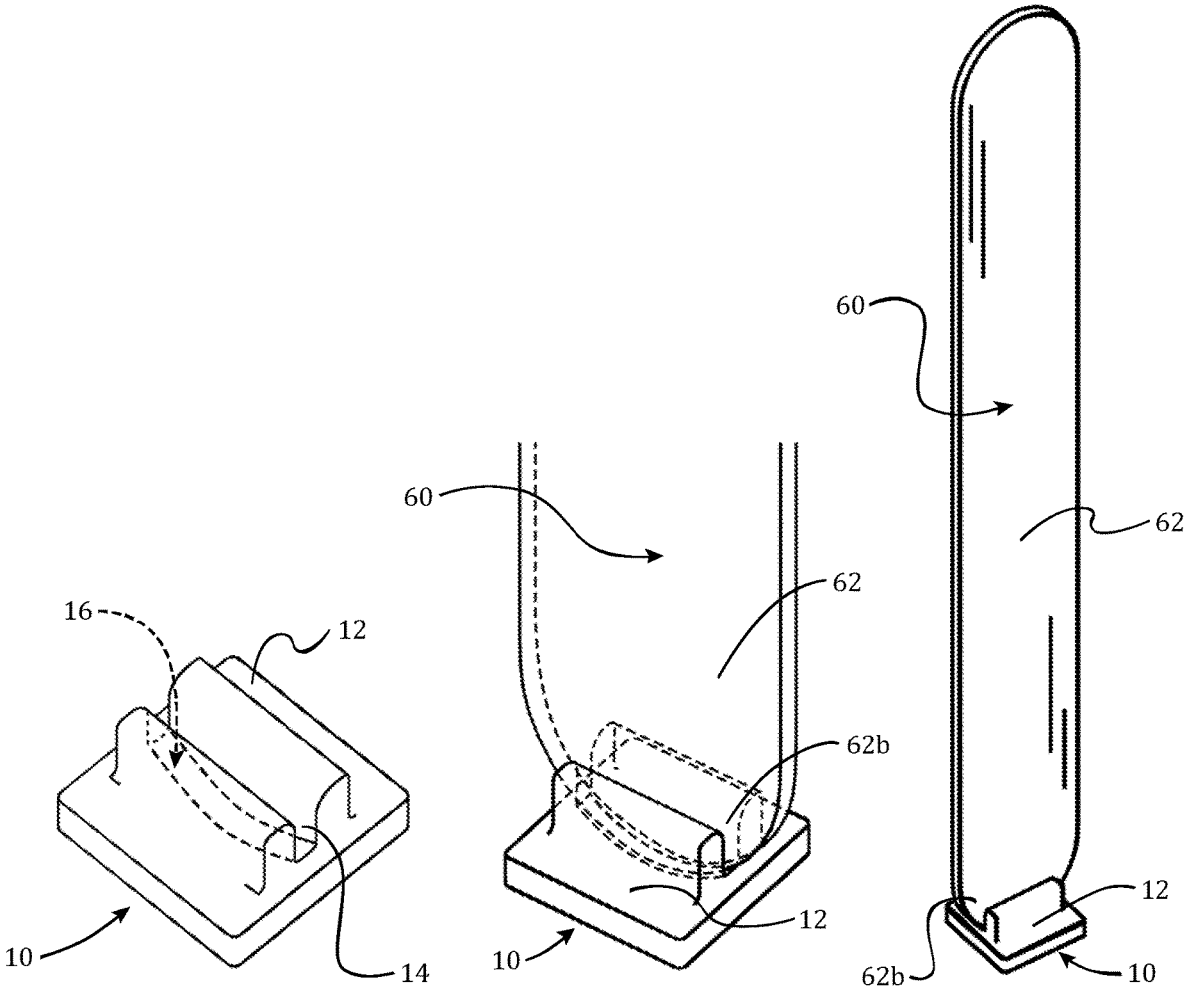
FIG. 4 illustrates perspective views of a stick member and a base connector member according to the first illustrative embodiment.
FIG. 4A is an enlarged perspective view of the base connector member illustrated in FIG. 1A, wherein the curved bottom surface of the base connector member is clearly illustrated.
FIG. 4B is an enlarged perspective view illustrating a stick member attached to the base connector member of FIG. 4A.
FIG. 4C is an overall perspective view illustrating the stick member attached to the base connector member of FIG. 4A.
Figure 7:
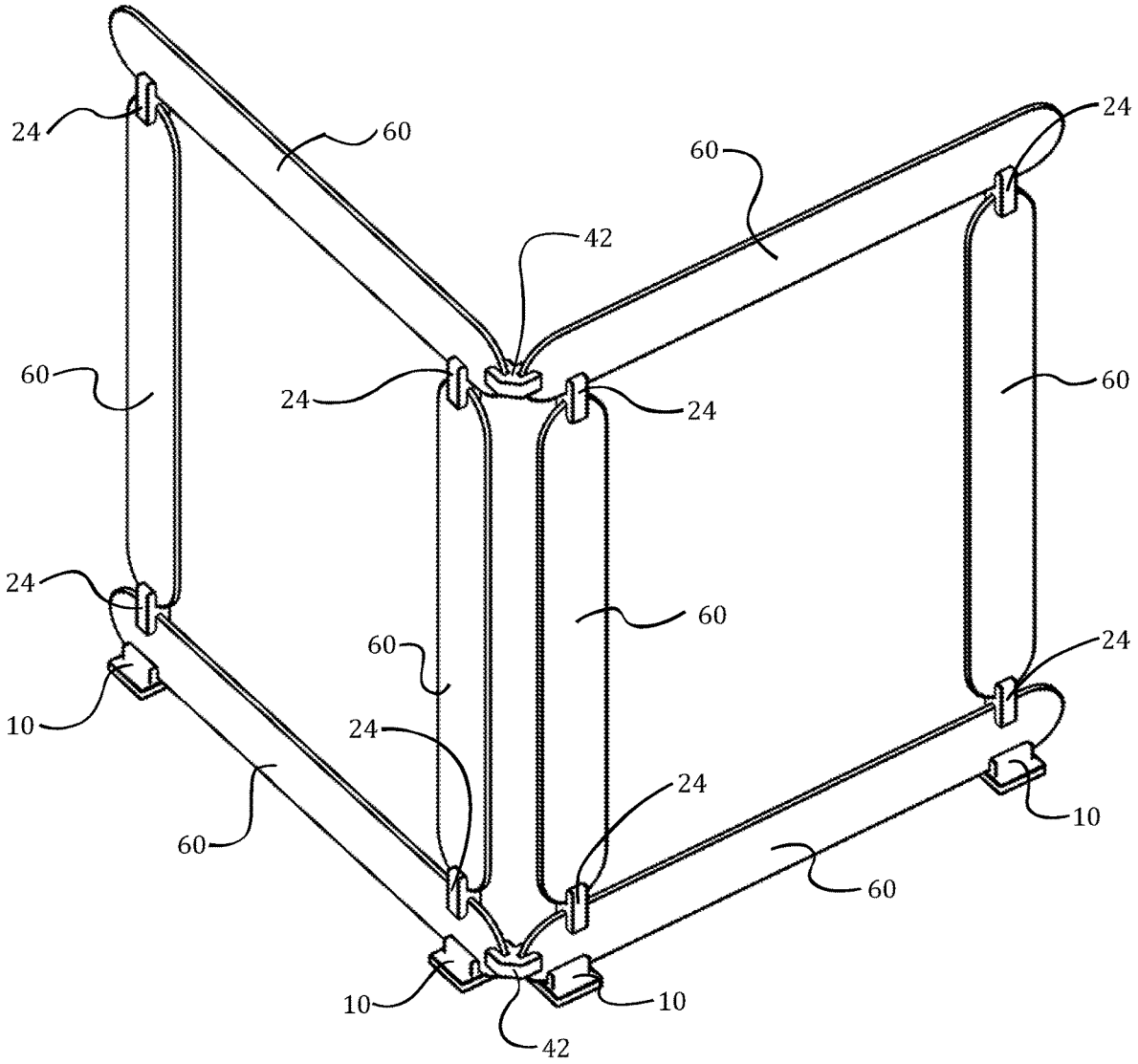
FIG. 7 is a perspective view of a wall-like structure that was formed using the stick members of the building toy set and the connector members of FIGS. 1A, 1C, and 1F.

In the first illustrative embodiment, as shown in FIGS. 4C and 7, the base connectors 10 of the building toy set 100 support the elongate stick members 60 on a support surface, such as a table, floor, etc. The base connectors 10 may be used to support the elongate stick members 60 either in an upright vertical position (see FIG. 4C) or in a horizontal position (see FIG. 7) where the elongate stick members 60 longitudinally extend along the support surface. In the first illustrative embodiment, the inside bottom surface 16 of the slot 14 substantially conforms to the end curvature of the rounded ends 62*a*, 62*b* of the elongate stick members 60 so as to help support the rounded end 62*a*, 62*b* of the stick members 60 when they are placed in a vertical position (i.e., the FIG. 4C position).

In the first illustrative embodiment, as shown in FIGS. 6A and 7, the straight connectors 24 of the building toy set 100 are used to connect any sides of two stick members 60 together. That is, the straight connectors 24 can be used for end-to-end connections between stick members 60, end-to-side connections between stick members 60, and/or side-to-side connections between stick members 60. The 90 degree connectors 42 of the illustrative building toy set 100 are used to connect stick members 60 together at right angles (i.e., 90 degree angles) so as to create corners in the structure being built (refer to FIGS. 6B and 7).

As shown in FIG. 5G, in the first illustrative embodiment, the basic version of the building toy set 100 may further include one or more T-joint connectors 108, each T-joint connector 108 having a body portion 110 defining three slots 112, 114. In the T-joint connector 108, the first and second ones 112 of the three slots are oppositely disposed and aligned (see FIG. 5G), while a third one 114 of the three slots is disposed at a 90 degree angle relative to the first and second ones 112 of the three slots. In other words, each T-joint connector 108 is in the form of a three sided connector with two ends facing each other and one side oriented at a 90 degree angle to act as a "T" Joint.

As shown in FIG. 1B, in the first illustrative embodiment, the basic version of the building toy set 100 may further include one or more eight-sided connectors 18, each eight-sided connector 18 having a body portion 20 defining eight slots 22. In the eight-sided connector 18, each of the eight slots 22 is successively spaced apart from one another by forty-five degrees. The eight-sided connector 18 is used for connecting eight sticks 60 together in 45 degree increments around the center point (e.g., see the top of the rocket ship 200 in FIG. 3).

As shown in FIG. 1E, in the first illustrative embodiment, the basic version of the building toy set 100 may further include one or more two-sided 135 degree connectors 36, each two-sided 135 degree connector 36 having a body portion 38 defining two slots 40 spaced apart from one another by 135 degrees. The two-sided 135 degree connector 36 is used for creating angled corners where two sticks 60 are connected together at a 135 degree angle (e.g., see the upper portion of the rocket ship 200 in FIG. 3).

As shown in FIG. 1G, in the first illustrative embodiment, the basic version of the building toy set 100 may further include one or more two-sided 60 degree connectors 48, each two-sided 60 degree connector 48 having a body portion 50 defining two slots 52 spaced apart from one another by 60 degrees. The two-sided 60 degree connector 48 is used for creating triangular corners where two sticks 60 are connected together at a 60 degree angle (e.g., see the base of the rocket ship 200 in FIG. 3).

As shown in FIG. 1H, in the first illustrative embodiment, the basic version of the building toy set 100 may further include one or more three-sided connectors 54, each three-sided connector 54 having a body portion 56 defining three slots 57, 58. In the three-sided connector 54, the first and second ones 58 of the three slots are spaced apart from one another by 90 degrees, while a third one 57 of the three slots is disposed at a 135 degree angle relative to the first and second ones 58 of the three slots. In other words, each three-sided connector 54 is provided with one 90 degree angle and two 135 degree angles for branching off a corner of a structure (e.g., see the tops of the fins of the rocket ship 200 in FIG. 3).

As shown in FIG. 5E, in the first illustrative embodiment, the basic version of the building toy set 100 may further include one or more two-sided parallel connectors 96, each two-sided parallel connector 96 having a body portion 98 defining two slots 99. In the two-sided parallel connector 96, each of the two slots 99 is disposed adjacent to, and extends parallel to one another. The two-sided parallel connector 96 is a two-sided connector with both sides facing the same direction, thus allowing two sticks 60 to run parallel to each other, which adds strength when building large structures.

As shown in FIG. 5I, in the first illustrative embodiment, the basic version of the building toy set 100 may further include one or more four-sided connectors 124, each four-sided connector 124 having a body portion 126 defining four slots 128. In the four-sided connector 124, each of the four slots 128 is successively spaced apart from one another by ninety degrees. The four-sided connector 124 is a four-sided connector with 90 degree angles so as to act as a cross connector for four (4) sticks 60.

In addition to the connector members 10, 18, 24, 36, 42, 48, 54, 96, 108, 124 described above, in the first illustrative embodiment, an extended version of the building toy set 100 may further include the connector members 30, 68, 74, 80, 88, 102, and 116 that are depicted in FIGS. 1D, 5A, 5B, 5C, 5D, 5F, and 5H, respectively. The structural features of these connector members 30, 68, 74, 80, 88, 102, and 116 will be explained hereinafter.

As shown in FIG. 1D, in the first illustrative embodiment, the extended version of the building toy set 100 may further include one or more two-sided perpendicular connectors 30, each two-sided perpendicular connector 30 having a body portion 32 defining two slots 34, 35. In the two-sided perpendicular connector 30, a first one 34 of the two slots extends perpendicular to a second one 35 of the two slots. The two-sided perpendicular connector 30 is a two-sided connector that allows a stick 60 to connect at a 90 degree angle right in the middle of another stick 60.

As shown in FIG. 5A, in the first illustrative embodiment, the extended version of the building toy set 100 may further include one or more three-sided 120 degree connectors 68, each three-sided 120 degree connector 68 having a body portion 70 defining three slots 72. In the three-sided 120 degree connector 68, each of the three slots is spaced apart from one another by 120 degrees. In other words, the three-sided 120 degree connector 68 has three 120 degree angles to create a center connecting point for three sticks 60.

As shown in FIG. 5B, in the first illustrative embodiment, the extended version of the building toy set 100 may further include one or more two-sided offset connectors 74, each two-sided offset connector 74 having a body portion 76 defining two offset, parallel extending slots 78. In the two-sided offset connector 74, a first one of the slots 78 is laterally offset from a second one of the slots 78. The two-sided offset connector 74 is a two-sided connector with an offset for creating offset sticks 60 in a structure.

As shown in FIG. 5C, in the first illustrative embodiment, the extended version of the building toy set 100 may further include one or more two-sided upturned left connectors 80, each two-sided upturned left connector 80 having a body portion 82 defining two slots 84, 86. In the two-sided upturned left connector 80, a first one 84 of the two slots extends perpendicular to a second one 86 of the two slots.

The two-sided upturned left connector 80 is a two-sided connector with one side turned 90 degrees upward to create extra support when bridging a horizontal stick 60 between two vertical sticks 60.

As shown in FIG. 5D, in the first illustrative embodiment, the extended version of the building toy set 100 may further include one or more two-sided upturned right connectors 88, each two-sided upturned right connector 88 having a body portion 90 defining two slots 92, 94. In the two-sided upturned right connector 88, a first one 92 of the two slots extends perpendicular to a second one 94 of the two slots. The two-sided upturned right connector 88 is a two-sided connector with one side turned 90 degrees upward to create extra support when bridging a horizontal stick 60 between two vertical sticks 60.

As shown in FIG. 5F, in the first illustrative embodiment, the extended version of the building toy set 100 may further include one or more four-sided parallel connectors 102, each four-sided parallel connector 102 having a body portion 104 defining four slots 106. In the four-sided connector 102, each of the four slots 106 extends parallel to one another with one pair of slots 106 facing in a direction opposite to the other pair of slots 106. The four-sided parallel connector 102 is a four-sided connector with abilities similar to the two-sided parallel connector 96 in FIG. 5E. The only difference is that the four-sided parallel connector 102 of FIG. 5F allows the amount of sticks 60 that are reinforced to be doubled.

As shown in FIG. 5H, in the first illustrative embodiment, the extended version of the building toy set 100 may further include one or more three-sided middle T-joint connectors 116, each three-sided middle T-joint connector 116 having a body portion 118 defining three slots 120, 122. In the three-sided middle T-joint connector 116, the first and second ones 120 of the three slots are oppositely disposed and aligned (see FIG. 5H), while a third one 122 of the three slots is disposed at a 90 degree angle relative to the first and second ones 120 of the three slots. In other words, the three-sided middle T-joint connector 116 is a three-sided connector with two ends facing each other and one side disposed at a 90 degree angle to act as a "T" joint. The middle section is inset to allow both side sticks 60 to meet in the middle of the stick 60 that is centrally disposed.

In the first illustrative embodiment, the connector members 10, 18, 24, 30, 36, 42, 48, 54, 68, 74, 80, 88, 96, 102, 108, 116, 124 of the building toy set 100 may be formed from a suitable polymeric material or plastic. Alternatively, the connector members 10, 18, 24, 30, 36, 42, 48, 54, 68, 74, 80, 88, 96, 102, 108, 116, 124 of the building toy set 100 may be formed from a suitable wood material or metal. In the first illustrative embodiment, the slot width of the slots in each of the connector members 10, 18, 24, 30, 36, 42, 48, 54, 68, 74, 80, 88, 96, 102, 108, 116, 124 may be slightly less than the thickness of the elongate sticks 60 (e.g., slightly less than 0.06 inches, such as 0.059 inches) so that the elongate sticks 60 fit in the slots of the connector members with a slight friction fit.

A second illustrative embodiment of the building toy set is shown in FIGS. 8A-12A. Referring to these figures, it can be seen that, in many respects, the second illustrative embodiment is similar to that of the first illustrative embodiment. Moreover, many elements are common to both such embodiments. For the sake of brevity, the elements that the second embodiment of the building toy set has in common with the first embodiment will not be discussed in detail because these components have already been described above.

Like the first embodiment of the building toy set described above, the second embodiment of the building toy set generally comprises a plurality of elongate stick members 60 (see FIGS. 1I, 10A, and 10C) and a plurality of connector members 18', 24', 36', 42', 48', 96', 102' (see FIGS. 8A-8G). However, unlike the first embodiment, the plurality of connector members 18', 24', 36', 42', 48', 96', 102' have bulb-shaped slots (see FIGS. 8A-8G and 11A), rather than the generally straight slots of the first embodiment. More specifically, with reference to the exemplary straight connector member 24' depicted in the detail view of FIG. 11A, it can be seen that each slot 28' has a curved wall proximal portion 25', a straight wall intermediate portion 27', a curved wall distal portion 29', and a straight back wall portion 31' forming the distal end of the slot 28'. In the second illustrative embodiment, the slots 22', 40', 46', 52', 99', 106' of the other connector members 18', 36', 42', 48', 96', 102' have slot geometries that are generally the same as the slots 28' of the straight connector member 24'.

Advantageously, the bulb-shaped slots of the connector members 18', 24', 36', 42', 48', 96', 102' of the second embodiment are designed to allow for more flexibility of the arms of the connector members 18', 24', 36', 42', 48', 96', 102' as the sticks 60 are pushed in and pulled out of the connector members 18', 24', 36', 42', 48', 96', 102'. The bulb-shaped slots of the connector members 18', 24', 36', 42', 48', 96', 102' also create extra space for the side of the stick 60 to maneuver back and forth. With this ability, as will be described in more detail hereinafter, a user of the building toy set is able to create radii with straight pieces (e.g., curved wall sections). In addition, the bulb-shaped slots of the connector members 18', 24', 36', 42', 48', 96', 102' allow the sticks 60 to flex in multiple directions as the user builds a structure with the building toy set.

Figures 11, 11A:
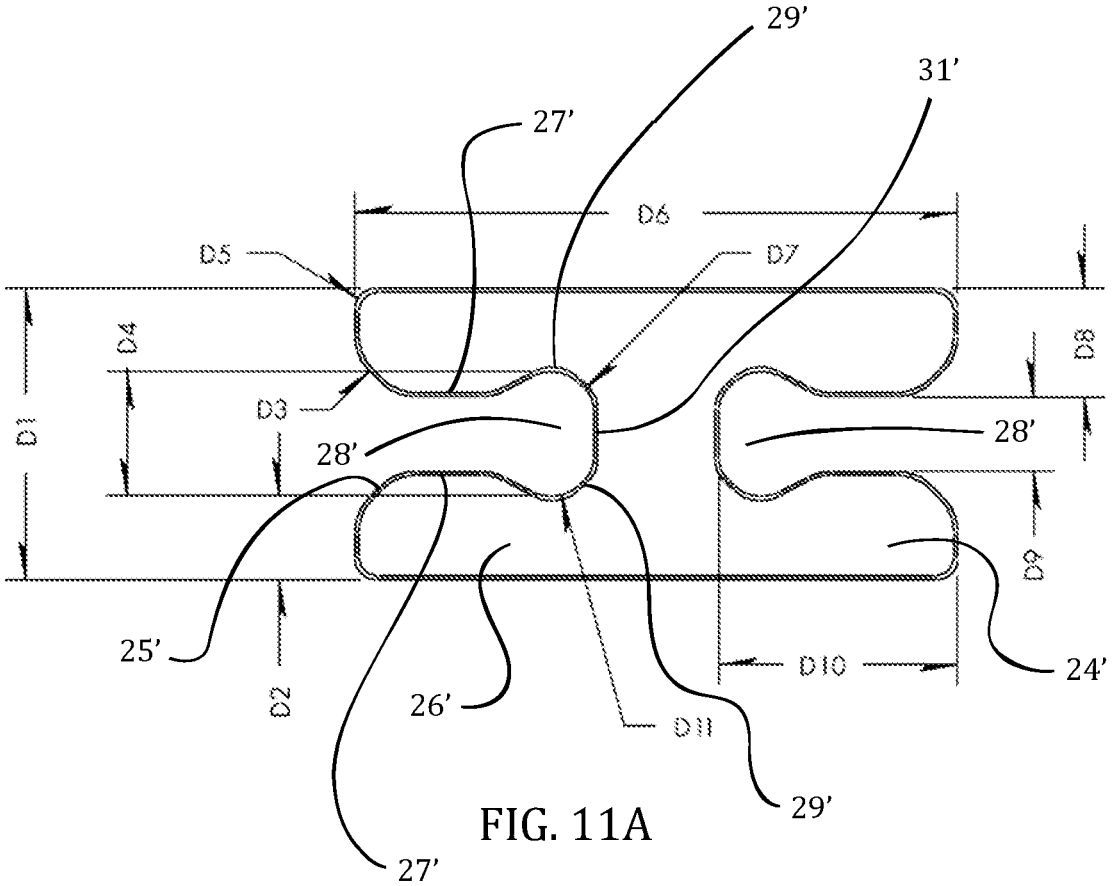
FIG. 11 presents an enlarged detail view of a connector member according to the second illustrative embodiment.
FIG. 11A is an enlarged detail view of the connector member of FIG. 8E illustrating the geometry of the connector member.

In the second illustrative embodiment, with reference to FIGS. 8E and 11A, the basic version of the building toy set includes a plurality of the straight connectors 24'. The straight connectors 24' of the building toy set are used to connect any sides of two stick members 60 together. That is, the straight connectors 24' can be used for end-to-end connections between stick members 60, end-to-side connections between stick members 60, and/or side-to-side connections between stick members 60. As shown in FIGS. 8E and 11A, each of the straight connectors 24' has a body portion 26' defining aligned oppositely disposed slots 28'.

Turning again to FIG. 11A, each straight connector 24' of the second illustrative embodiment may have an overall length D6 of approximately 12.07 millimeters and an overall width D1 of approximately 5.84 millimeters. The narrowest section of each arm of the straight connector 24' may have a width D2 of approximately 1.67 millimeters, and the widest section of each arm of the straight connector 24' may have a width D8 of approximately 2.17 millimeters.

The outer corner of each arm of the straight connector 24' may have a radius D5 of approximately 0.40 millimeters. Referring again to FIG. 11A, the narrowest portion of each slot 28' of the straight connector 24' may have a width D9 of approximately 1.50 millimeters, and the widest section of each slot 28' of the straight connector 24' may have a width D4 of approximately 2.50 millimeters. The curved wall proximal portion 25' of each slot 28' of the straight connector 24' may have a radius D3 of approximately 1.0 millimeter. One side of the curved wall distal portion 29' of each slot 28' of the straight connector 24' may have a radius D7 of approximately 0.60 millimeters, and the other side of the curved wall distal portion 29' of each slot 28' of the straight connector 24' may have a radius D11 of approximately 0.80 millimeters. Each slot 28' of the straight connector 24' may have an overall depth D10 of approximately 4.78 millimeters.

As shown in FIG. 8A, in the second illustrative embodiment, the basic version of the building toy set may further include one or more two-sided parallel connectors 96', each two-sided parallel connector 96' having a body portion 98' defining two slots 99'. In the two-sided parallel connector 96', each of the two slots 99' is disposed adjacent to, and extends parallel to one another. The two-sided parallel connector 96' is a two-sided connector with both sides facing the same direction, thus allowing two sticks 60 to run parallel to each other, which adds strength when building large structures.

As shown in FIG. 8B, in the second illustrative embodiment, the basic version of the building toy set may further include one or more 90 degree connectors 42' having a body portion 44' defining slots 46' oriented at 90 degrees relative to one another (see FIG. 8B). The two-sided 90 degree connector 42' allows two sticks 60 to be connected to one another at a generally 90 degree angle.

As shown in FIG. 8D, in the second illustrative embodiment, the basic version of the building toy set may further include one or more two-sided 135 degree connectors 36', each two-sided 135 degree connector 36' having a body portion 38' defining two slots 40' spaced apart from one another by 135 degrees. The two-sided 135 degree connector 36' is used for creating angled corners where two sticks 60 are connected together at a 135 degree angle.

As shown in FIG. 8F, in the second illustrative embodiment, the basic version of the building toy set may further include one or more two-sided 60 degree connectors 48', each two-sided 60 degree connector 48' having a body portion 50' defining two slots 52' spaced apart from one another by 60 degrees. The two-sided 60 degree connector 48' is used for creating triangular corners where two sticks 60 are connected together at a 60 degree angle.

As shown in FIG. 8G, in the second illustrative embodiment, the basic version of the building toy set may further include one or more eight-sided connectors 18', each eight-sided connector 18' having a body portion 20' defining eight slots 22'. In the eight-sided connector 18', each of the eight slots 22' is successively spaced apart from one another by forty-five degrees. The eight-sided connector 18' is used for connecting eight sticks 60 together in 45 degree increments around the center point.

Figures 10, 10A, 10B, 10C:
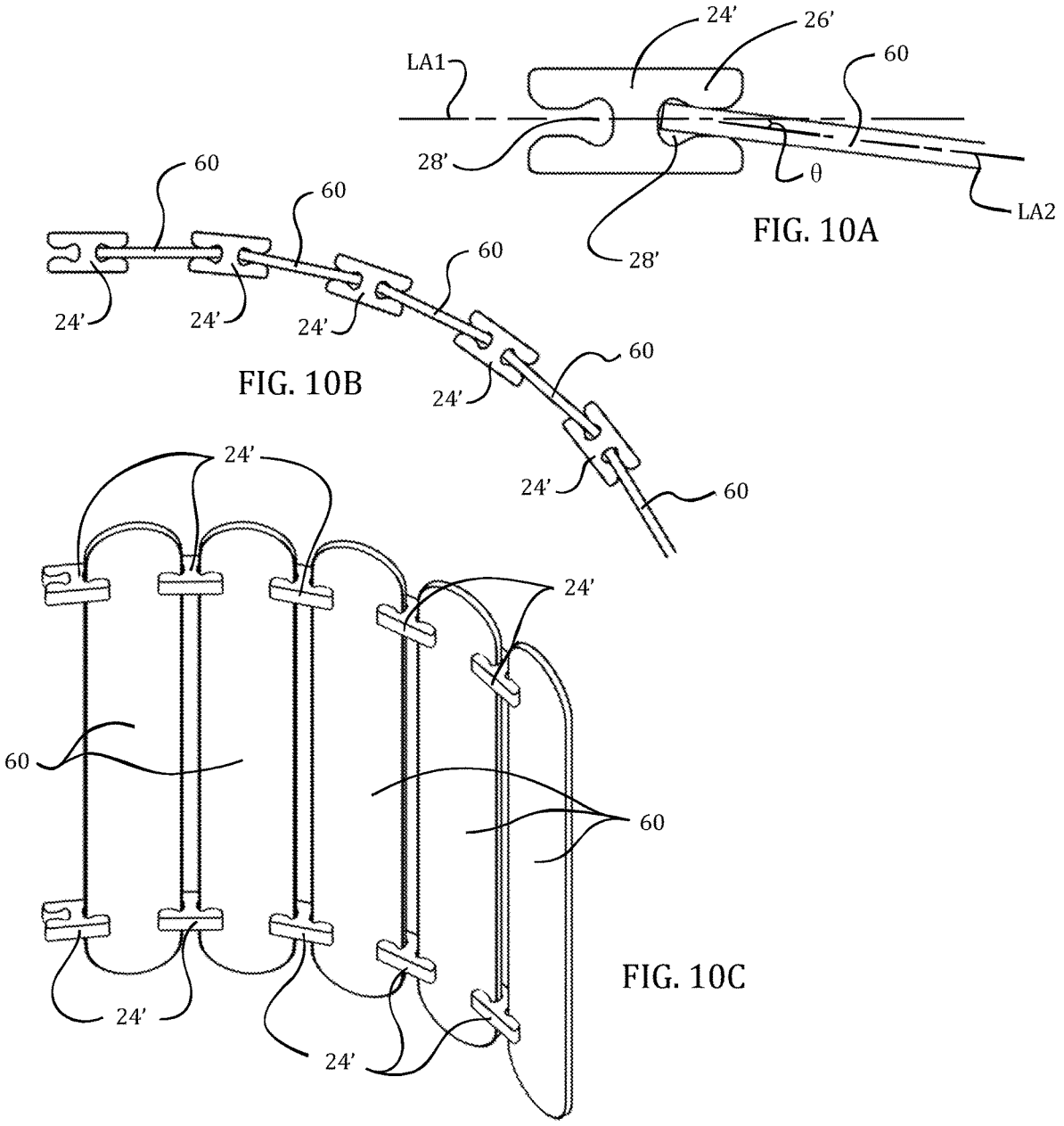
FIG. 10 illustrates top and perspective views of stick members attached by connector members according to the second illustrative embodiment.
FIG. 10A is a top view illustrating a stick member angularly disposed in a slot of the connector member of FIG. 8E.
FIG. 10B is a top view illustrating the manner in which a curved wall of sticks may be formed using a plurality of connector members of FIG. 8E having bulb-shaped slots.
FIG. 10C is a perspective view of the curved wall of sticks illustrated in FIG. 10B.

In the second illustrative embodiment, as shown in FIGS. 9A, 10B, and 10C, the straight connectors 24' of the building toy set are used to connect any sides of two stick members 60 together. That is, the straight connectors 24' can be used for end-to-end connections between stick members 60, end-to-side connections between stick members 60, and/or side-to-side connections between stick members 60. In FIGS. 10B and 10C, it can be seen that the bulb-shaped slots 28' of the straight connectors 24' enable a curved wall of sticks 60 to be formed, which is not possible with the straight slot design of the first embodiment. FIG. 10A depicts a stick member 60 angularly disposed in one of the bulb-shaped slots 28' of the connector member 24' of FIG. 8E so as to illustrate the functionality of the bulb-shaped slot 28'. In FIG. 10A, it can be seen that the configuration of the bulb-shaped slot 28' of the connector member 24' enables the longitudinal axis LA2 of the stick member 60 to be disposed at an acute angle θ relative to a longitudinal axis LA1 of the body portion 26' of the connector member 24'. As shown in FIG. 9B, the 90 degree connectors 42' of the illustrative building toy set are used to connect stick members 60 together at right angles (i.e., 90 degree angles) so as to create corners in the structure being built.

In addition to the connector members 18', 24', 36', 42', 48', 96'described above, in the second illustrative embodiment, an extended version of the building toy set may further include the connector member 102' that is depicted in FIG. 8C. The structural features of this connector member 102' will be explained hereinafter.

As shown in FIG. 8C, in the second illustrative embodiment, the extended version of the building toy set may further include one or more four-sided parallel connectors 102', each four-sided parallel connector 102' having a body portion 104' defining four slots 106'. In the four-sided connector 102', each of the four slots 106' extends parallel to one another with one pair of slots 106' facing in a direction opposite to the other pair of slots 106'. The four-sided parallel connector 102' is a four-sided connector with abilities similar to the two-sided parallel connector 96' in FIG. 8A. The only difference is that the four-sided parallel connector 102' of FIG. 8C allows the amount of sticks 60 that are reinforced to be doubled.

It is readily apparent that the aforedescribed embodiments of the building toy set offer numerous advantages. First, the building toy set is capable of sparking creativity in the users thereof, and may further expand its user's knowledge of engineering. Secondly, the building toy set is relatively inexpensive, does not require the use of adhesives, and comprises reusable components. Thirdly, the building toy set helps to build relationships among the users thereof by, for example, bonding family members together. Finally, the building toy set helps children learn new skills.

Figure 3:
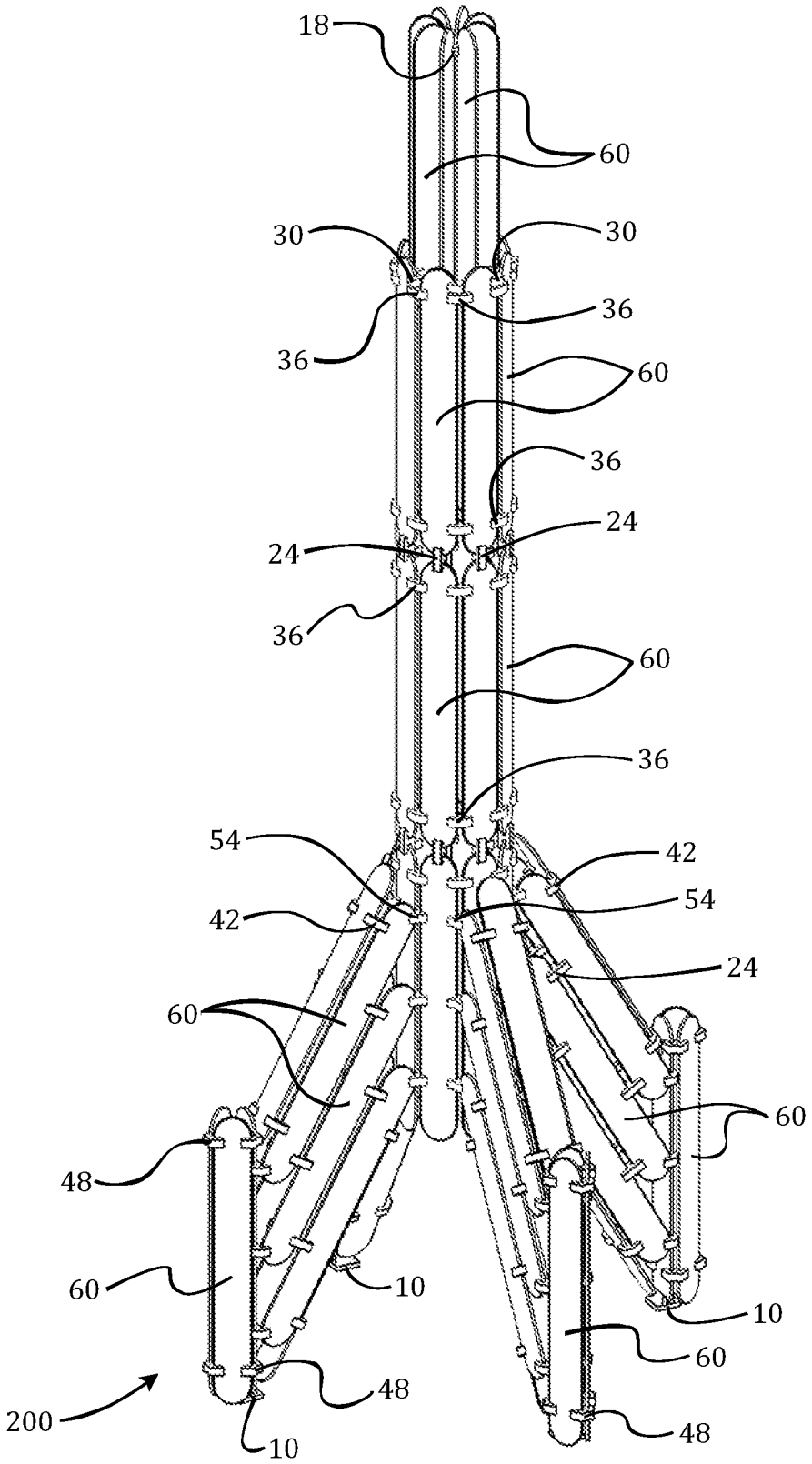
FIG. 3 illustrates a rocket ship that was formed using the first illustrative embodiment of the building toy set depicted in FIGS. 1A-1I.
Figures 12, 12A:
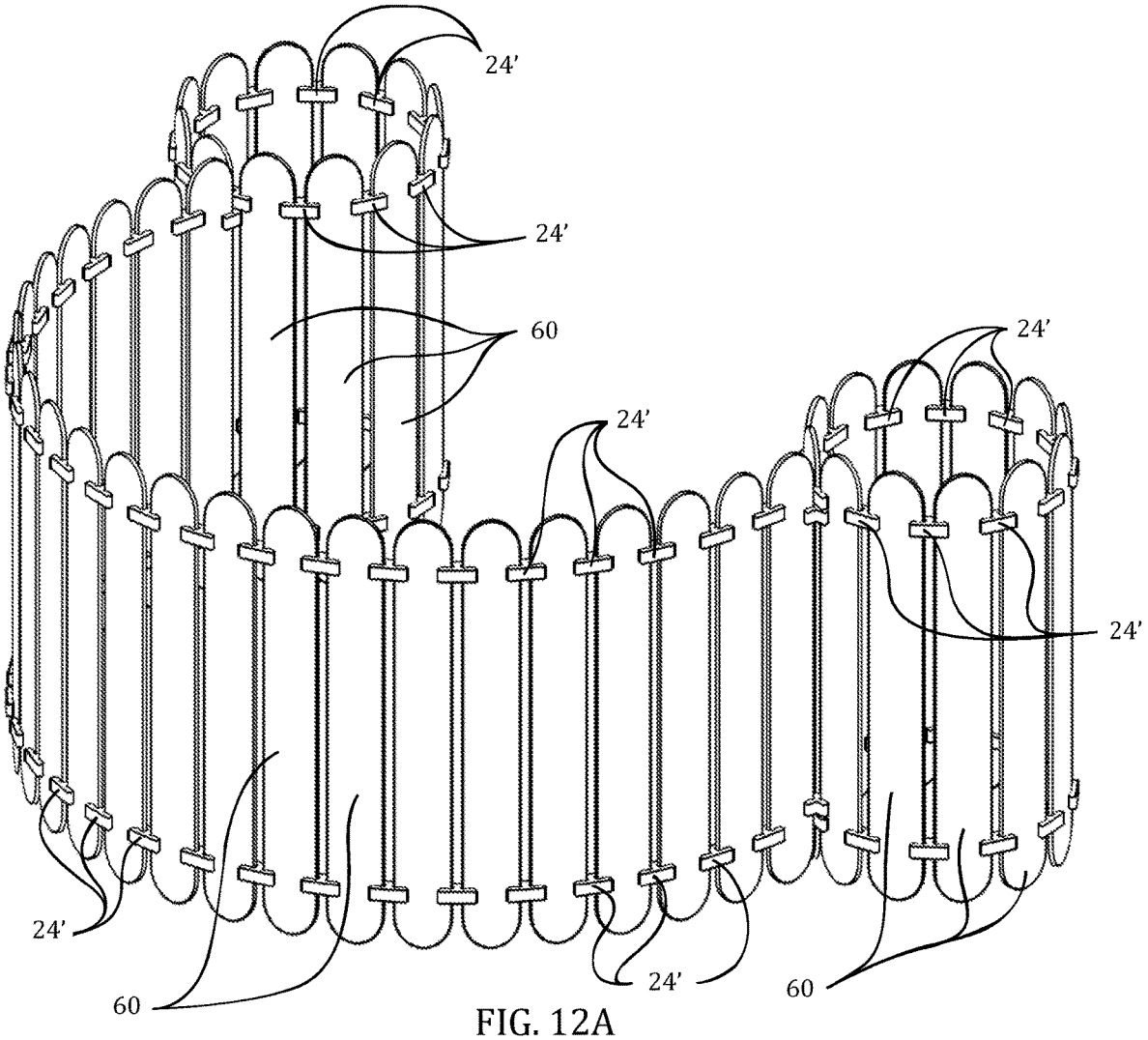
FIG. 12 presents a structure formed using the second illustrative embodiment of the building toy set.
FIG. 12A illustrates a curved wall structure that was formed using the second illustrative embodiment of the building toy set.

Advantageously, the embodiments of the building toy set described above may be used for constructing a myriad of different structures from stick members 60. For example, as shown in FIG. 3, the building toy set may be used to form a rocket ship 200. As another example, the building toy set may be used to form a castle or virtually any other type of building structure. In particular, as shown in FIG. 12A, the building toy set of the second embodiment may be used to form a curved fortress wall of a castle with two towers, which is possible with the increased functionality enabled by the bulb-shaped slots of the second embodiment.

Any of the features or attributes of the above described embodiments and variations can be used in combination with any of the other features and attributes of the above described embodiments and variations as desired.

Although the invention has been shown and described with respect to a certain embodiment or embodiments, it is apparent that this invention can be embodied in many different forms and that many other modifications and variations are possible without departing from the spirit and scope of this invention.

Moreover, while exemplary embodiments have been described herein, one of ordinary skill in the art will readily appreciate that the exemplary embodiments set forth above are merely illustrative in nature and should not be construed as to limit the claims in any manner. Rather, the scope of the invention is defined only by the appended claims and their equivalents, and not, by the preceding description.

The invention claimed is:

1. A building toy set, comprising:

a plurality of elongate stick members, at least one of the plurality of elongate stick members having at least one rounded end; and a plurality of connector members, at least one of the plurality of connector members being in the form of a two-sided parallel connector having a body portion defining two slots, each of the two slots being disposed adjacent to, and extending parallel to one another, and at least another one of the plurality of connector members comprising a connector body portion with flexible arms defining a bulb-shaped slot, the bulb-shaped slot being bounded by a straight wall portion and at least one curved wall portion, the straight wall portion of the bulb-shaped slot being located closer to an entrance of the bulb-shaped slot than the at least one curved wall portion, the at least one curved wall portion defining a concave recess in the connector body portion adjacent to the straight wall portion, the at least one curved wall portion of the bulb-shaped slot enabling one of the plurality of elongate stick members to be disposed at an angle relative to a longitudinal axis of the connector body portion by means of an end portion of the one of the plurality of elongate stick members being received in the concave recess of the connector body portion, the one of the plurality of elongate stick members being angled in a first plane that is offset from a second plane defined by the longitudinal axis of the connector body portion, the one of the plurality of elongate stick members having a uniform thickness and a solid stick body portion, the concave recess of the bulb-shaped slot having a width that is greater than the uniform thickness of the one of the plurality of elongate stick members for enabling the angular offset of the one of the plurality of elongate stick members relative to the longitudinal axis of the connector body portion, the solid stick body portion of the one of the plurality of elongate stick members diagonally extending through the entrance of the bulb-shaped slot and into the at least one curved wall portion of the bulb-shaped slot, and the flexible arms of the connector body portion enabling the angular offset of the one of the plurality of elongate stick members relative to the longitudinal axis of the connector body portion while the angular offset of the one of the plurality of elongate stick members is constrained by the bulb-shaped slot.

2. The building toy set according to claim 1, wherein the at least one rounded end of the at least one of the plurality of elongate stick members comprises a first rounded end and a second rounded end, the first rounded end being oppositely disposed relative to the second rounded end.

3. The building toy set according to claim 1, wherein the plurality of connector members further comprise a straight connector having a body portion defining aligned oppositely disposed slots.

4. The building toy set according to claim 1, wherein the plurality of connector members further comprise a 90 degree connector having a body portion defining two slots oriented at 90 degrees relative to one another.

5. The building toy set according to claim 1, wherein the plurality of connector members further comprise a T-joint connector having a body portion defining three slots, first and second ones of the three slots being oppositely disposed and aligned, and a third one of the three slots being disposed at a 90 degree angle relative to the first and second ones of the three slots.

6. The building toy set according to claim 1, wherein the plurality of connector members further comprise an eight-sided connector having a body portion defining eight slots, each of the eight slots being successively spaced apart from one another by forty-five degrees.

7. The building toy set according to claim 1, wherein the plurality of connector members further comprise a two-sided 135 degree connector having a body portion defining two slots spaced apart from one another by 135 degrees.

8. The building toy set according to claim 1, wherein the plurality of connector members further comprise a two-sided 60 degree connector having a body portion defining two slots spaced apart from one another by 60 degrees.

9. The building toy set according to claim 1, wherein the plurality of connector members further comprise a base connector having a body portion defining an upwardly extending slot, the upwardly extending slot of the base connector being bounded by a curved bottom surface to accommodate an insertion of the at least one rounded end of the at least one of the plurality of elongate stick members into the upwardly extending slot.

10. The building toy set according to claim 1, wherein the plurality of connector members further comprise a four-sided connector having a body portion defining four slots, each of the four slots being successively spaced apart from one another by ninety degrees.

11. The building toy set according to claim 1, wherein the plurality of connector members further comprise a three-sided connector having a body portion defining three slots, first and second ones of the three slots being spaced apart from one another by 90 degrees, and a third one of the three slots being disposed at a 135 degree angle relative to the first and second ones of the three slots.

12. A building toy set, comprising:

a plurality of elongate stick members, at least one of the plurality of elongate stick members having at least one rounded end; and a plurality of connector members, at least one of the plurality of connector members comprising a connector body portion with flexible arms defining a bulb-shaped slot, the bulb-shaped slot being bounded by a straight wall portion and at least one curved wall portion, the straight wall portion of the bulb-shaped slot being located closer to an entrance of the bulb-shaped slot than the at least one curved wall portion, the at least one curved wall portion defining a concave recess in the connector body portion adjacent to the straight wall portion, the at least one curved wall portion of the bulb-shaped slot enabling one of the plurality of elongate stick members to be disposed at an angle relative to a longitudinal axis of the connector body portion by means of an end portion of the one of the plurality of elongate stick members being received in the concave recess of the connector body portion, the one of the plurality of elongate stick members being angled in a first plane that is offset from a second plane defined by the longitudinal axis of the connector body portion, the one of the plurality of elongate stick members having a uniform thickness and a solid stick body portion, the concave recess of the bulb-shaped slot having a width that is greater than the uniform thickness of the one of the plurality of elongate stick members for enabling the angular offset of the one of the plurality of elongate stick members relative to the longitudinal axis of the connector body portion, the solid stick body portion of the one of the plurality of elongate stick members diagonally extending through the entrance of the bulb-shaped slot and into the at least one curved wall portion of the bulb-shaped slot, and the flexible arms of the connector body portion enabling the angular offset of the one of the plurality of elongate stick members relative to the longitudinal axis of the connector body portion while the angular offset of the one of the plurality of elongate stick members is constrained by the bulb-shaped slot.

13. The building toy set according to claim 12, wherein the at least one rounded end of the at least one of the plurality of elongate stick members comprises a first rounded end and a second rounded end, the first rounded end being oppositely disposed relative to the second rounded end.

14. The building toy set according to claim 12, wherein at least one of the plurality of connector members comprises a 90 degree connector having a body portion defining two slots oriented at 90 degrees relative to one another.

15. The building toy set according to claim 12, wherein at least one of the plurality of connector members comprises an eight-sided connector having a body portion defining eight slots, each of the eight slots being successively spaced apart from one another by forty-five degrees.

16. The building toy set according to claim 12, wherein at least one of the plurality of connector members comprises a two-sided 135 degree connector having a body portion defining two slots spaced apart from one another by 135 degrees.

17. The building toy set according to claim 12, wherein at least one of the plurality of connector members comprises a two-sided 60 degree connector having a body portion defining two slots spaced apart from one another by 60 degrees.

18. The building toy set according to claim 12, wherein at least one of the plurality of connector members comprises a straight connector having a body portion defining aligned oppositely disposed slots.

19. The building toy set according to claim 12, wherein at least one of the plurality of connector members comprises a two-sided parallel connector having a body portion defining two slots, each of the two slots being disposed adjacent to, and extending parallel to one another.

20. The building toy set according to claim 12, wherein the at least one curved wall portion bounding the bulb-shaped slot comprises a proximal curved wall portion at an entrance to the bulb-shaped slot and a distal curved wall portion at a terminus of the bulb-shaped slot, the distal curved wall portion defining the concave recess in the connector body portion adjacent to the straight wall portion, and the proximal curved wall portion being disposed on a first side of the bulb-shaped slot that is opposite to a second side of the bulb-shaped slot on which the distal curved wall portion is disposed; and wherein the one of the plurality of elongate stick members diagonally extends between the proximal curved wall portion of the bulb-shaped slot and the distal curved wall portion of the bulb-shaped slot.

* * * * *